US005577806A

United States Patent [19]

Ugalde

[11] Patent Number: 5,577,806

[45] Date of Patent: Nov. 26, 1996

[54] ADJUSTABLE FOOTREST

[75] Inventor: Carlos V. Ugalde, Pomona, Calif.

[73] Assignee: Continental Engineering Group, Inc., Irwindale, Calif.

[21] Appl. No.: 322,320

[22] Filed: Oct. 13, 1994

[51] Int. Cl.[6] ..... A47C 16/00

[52] U.S. Cl. ..... 297/423.46; 108/5; 108/8; 248/397

[58] Field of Search ..... 297/423.46, 423.44, 297/423.39, 363; 108/1, 5, 6, 8; 248/371, 397

[56] References Cited

U.S. PATENT DOCUMENTS

| | | | |
|---|---|---|---|
| 269,780 | 12/1882 | Penny | 297/423.46 |
| 663,632 | 12/1900 | Mack | 297/423.46 |
| 815,046 | 3/1906 | Sherman | 297/423.46 |
| 1,217,246 | 2/1917 | Wallace | 155/169 |
| 1,420,404 | 6/1922 | Beaver | 108/8 X |
| 2,528,331 | 10/1950 | Bell | 155/169 |
| 2,850,081 | 9/1958 | Dillon | 155/169 |
| 3,132,835 | 5/1964 | Drabert | 248/397 |
| 3,494,306 | 2/1970 | Aguilar | 108/6 |
| 3,653,715 | 4/1972 | Drabert et al. | 297/439 |
| 4,274,674 | 6/1981 | Delou et al. | 297/363 |
| 4,441,758 | 4/1984 | Fleischer et al. | 297/439 |
| 4,549,767 | 10/1985 | Hampshire et al. | 297/439 |
| 4,934,647 | 6/1990 | Edwards | 248/371 |
| 5,201,568 | 4/1993 | Christensen, Jr. | 297/439 |
| 5,294,180 | 3/1994 | Grimm | 297/423 |

OTHER PUBLICATIONS

Catalogue Stationers catalog, 1994, p. 548.
Action Computer Supplies catalog, 1994, p. 78.
SP Richards catalog, 1993, p. 77.
MicroSupplies Warehouse catalog, 1994, p. 47.
"Details" Foot Rest, Ivan Allen catalog, 1992.

*Primary Examiner*—Peter M. Cuomo
*Assistant Examiner*—Anthony D. Barfield
*Attorney, Agent, or Firm*—Christie, Parker & Hale, LLP

[57] ABSTRACT

A footrest has a platform with an upper surface for supporting a user's feet above a ground surface. The footrest is supported by a base portion on the ground surface. An intermediate member is rotatably coupled to the base portion and to the platform for relative rotation about first and second axes, respectively. The first and second axes are offset from each other so that selective rotations about said first and second axes provide for height and orientation adjustment of the platform relative to the ground surface.

20 Claims, 12 Drawing Sheets

ADJUSTABLE FOOTREST

FIELD OF THE INVENTION

Background of the Invention

The invention pertains to footrests. More particularly, the invention pertains to free standing footrests having adjustments for both platform height and angle.

Workplace ergonomics is an area which has drawn much attention over the past few years. Most persons who work at desks or tables are presented with such desks and tables at a pre-determined height. Such persons will typically have a height-adjustable chair which may be used to bring their upper body into a proper relationship with the desk. A common example involves a computer typist who must have his/her arms at an ergonomically appropriate angle for using the computer so as to minimize chances of repetitive stress injury.

Such adjustments, however, neglect the relationship of the worker to the floor of the work place. It is thus desirable to provide a footrest to bring the user's legs into an ergonomically correct position so as to avoid problems such as leg strain, back strain, and circulatory problems.

To provide the appropriate ergonomic environment, the footrest must provide a platform having both height and angle adjustments. It is desirable that such adjustments be accomplished with a minimum of effort and, in particular, without requiring the user to lift the footrest off the floor.

SUMMARY OF THE INVENTION

There is accordingly provided a footrest having an upper surface for accommodating the feet of a user and supporting them above the ground. A base comprising a pair of base members supports the footrest on the ground and a pair of intermediate members are mounted to the base members for carrying the platform. The intermediate members are rotatably coupled to the base members for relative rotation about a first axis and to the platform for relative rotation about a second axis which is offset from the first axis. Selective rotations of the intermediate and base members about the first axis and the intermediate members and platform about the second axis provide for height and orientation adjustment of the platform relative to the ground.

The two degrees of freedom presented by the height and angle adjustments allow a user to adjust the footrest to provide the optimum ergonomic environment. The footrest may, optionally, be placed in a floating mode wherein the angle of the platform may vary based upon the pressure applied by the user's feet. This permits the user to alter the angle between his or her feet and shins so as to prevent stiffness in the user's ankles while still providing support for the user's feet.

BRIEF DESCRIPTION OF THE DRAWINGS

The features of the specific embodiment of the best mode contemplated of carrying out the invention are illustrated in the drawings, in which.

DETAILED DESCRIPTION

Figure 1:
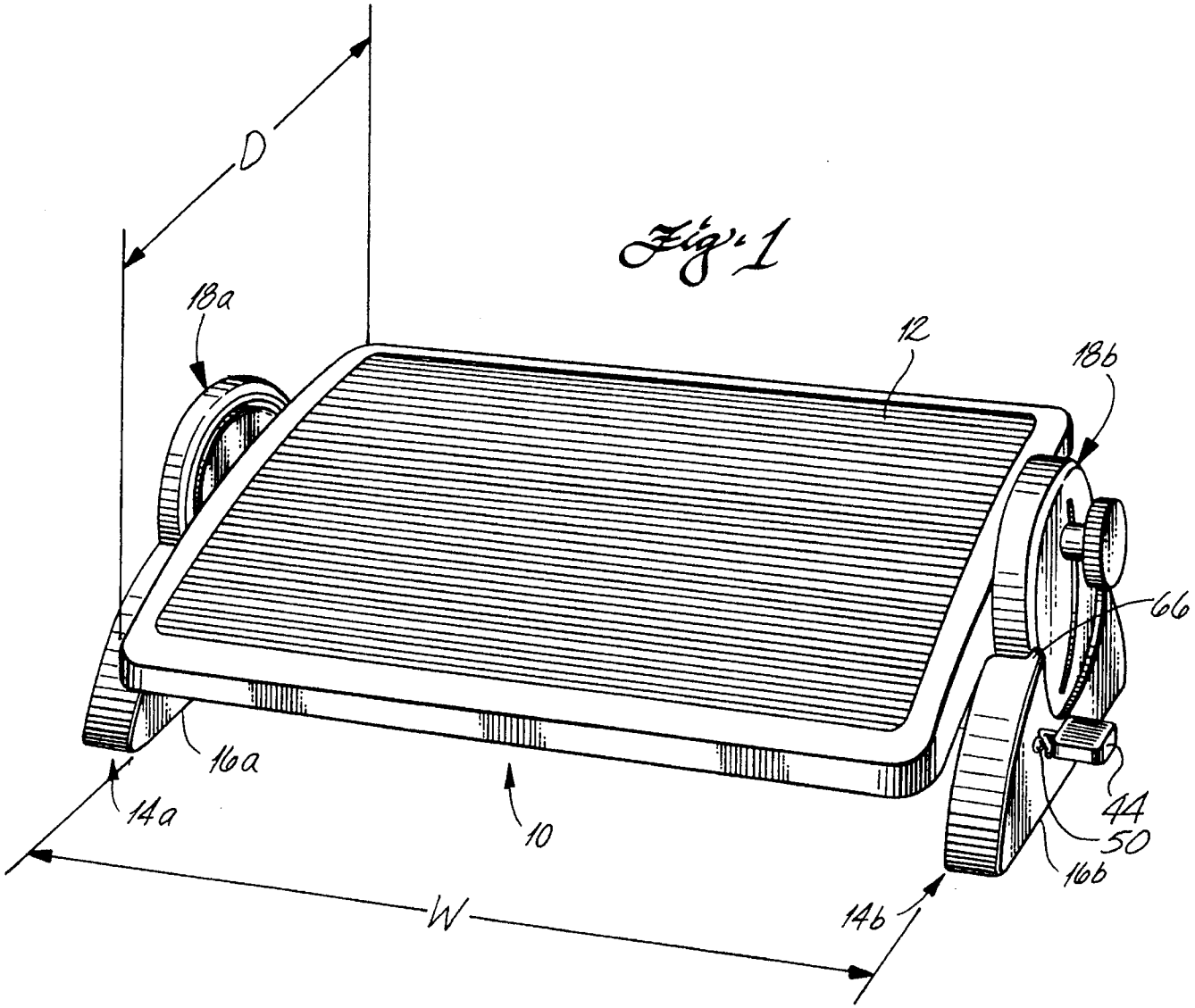
FIG. 1 is a perspective view of a footrest according to the principles of the present invention.

As is shown in FIG. 1, the preferred embodiment of a footrest according to principles of the invention has a substantially rectangular platform 10 having a carpeted upper surface 12 for accommodating the feet of a user and supporting the feet above the ground or other support surface. A pair of crescent-shaped left and right base members, 14*a* & 14*b*, respectively, are positioned adjacent the left and right sides the platform for supporting the footrest on the ground surface. The base members are oriented vertically with their chord faces 16*a* & 16*b*, respectively, lying flat atop of the ground. As is described in detail below, a pair of left and right circular intermediate members 18*a* & 18*b*, adjacent the left and right sides of the platform, respectively, are rotatably coupled to and carried by the respective left and right base members for relative rotation about a first axis 202 (see also FIG. 2). The platform is, in turn, carried by the intermediate members. Specifically, the platform is rotatably coupled to the intermediate members for rotation about a second axis 204 which is parallel to and offset from the first axis.

In the preferred embodiment, a platform, base members and intermediate members are all formed of a suitable material, such as injection molded acrylonitrile-butadiene-styrene (ABS). Exemplary dimensions of the platform of the footrest are 18 inches in width (W) and 13 inches in depth (D). The exemplary radius of intermediate members 18*a* and 18*b* is 8 inches and the base members are formed with a nominal radius of approximately 6.25 inches and a chord face 16*a* and 16*b* approximately 12 inches long.

Figure 2:
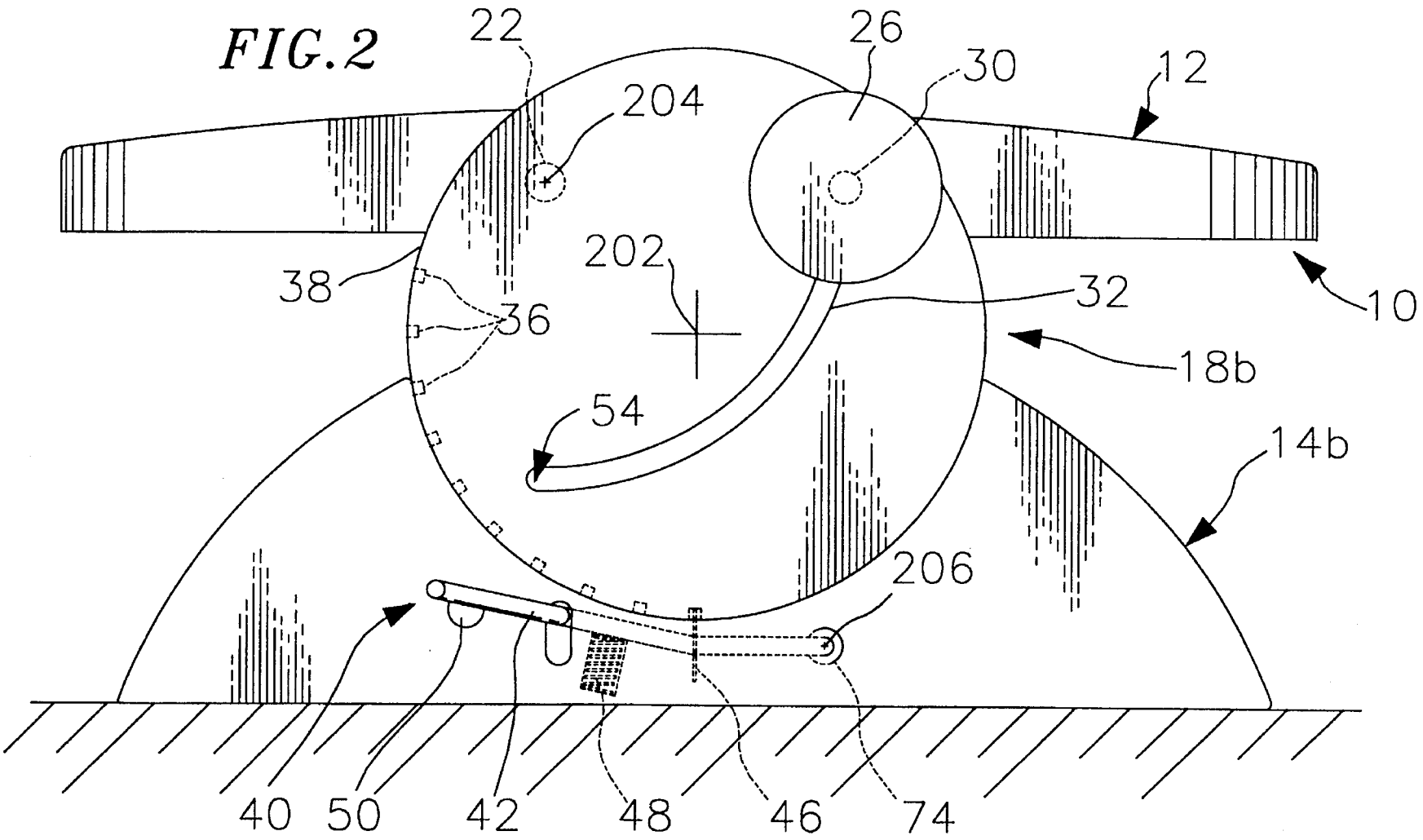
FIG. 2 is a semi-schematic right side view of the footrest shown in a horizontal, raised configuration.
Figure 3:
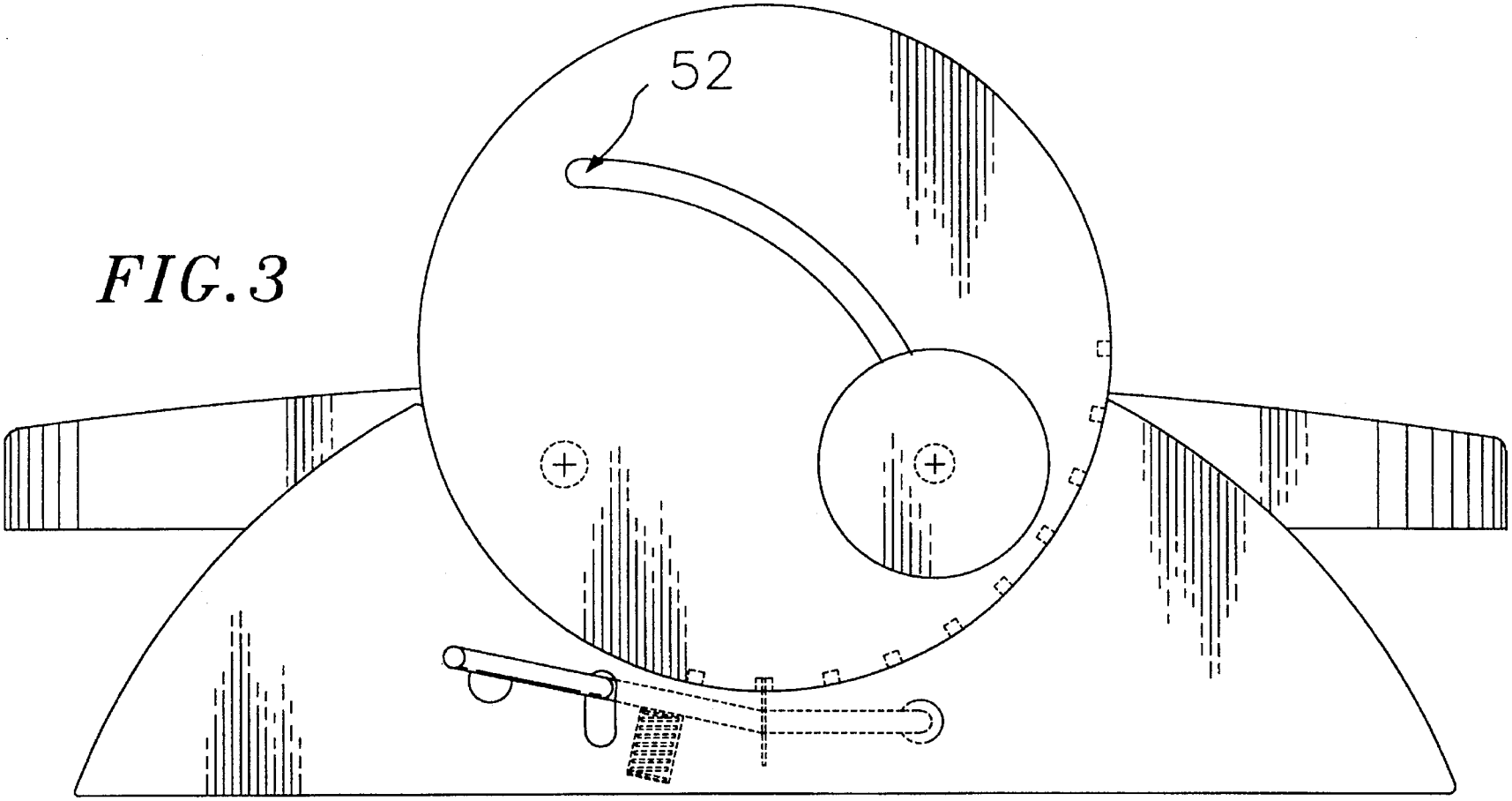
FIG. 3 is a semi-schematic right side view of the footrest shown in a horizontal, lowered configuration.

The broad structure and operation of the footrest is now described with reference to the semi-schematic illustrations of FIGS. 2–5. As shown in FIG. 2, the platform is carried by the intermediate members through a pair of pins 22 held by each intermediate member and extending laterally inward therefrom to be received by the platform. Whereas the intermediate members and base members are relatively rotatable about the first axis 202, the platform is rotatable relative to the intermediate members about the second axis 204 coincident with the central axis of the pins 22.

For restricting rotation of the platform and intermediate members, for each intermediate member a knob 26 is threaded onto a stud 30 which, at its base, is engaged and rigidly secured to the platform 12 and extends horizontally to the right passing through a slot 32 in the intermediate member 18*b*. The slot is of annular configuration, centered about the second axis 204. As the knob is tightened to the stud, it bears against the outer surface of the intermediate member so that friction between the knob and the intermediate member resist relative rotation of the intermediate member and platform.

As heretofore described, the left and right base members and intermediate members are otherwise identical mirror images of each other. In the illustrated embodiment, however, only the right base and intermediate members include means for selectively restricting rotation of the intermediate member relative to the base member.

Specifically, the intermediate member includes a plurality of locking features 36 which may be engaged by a locking member 40 on the base member for locking the two members together. Specifically, the locking features are formed as laterally extending slots, formed in the circular perimeter portion 38 of the intermediate member. The locking member 40 comprises a lever 42 which is pivotally connected to the base member for rotation about a lever axis 206. As is shown in FIG. 1, the lever carries a pedal 44 to facilitate actuation of the lever by the user's foot. To better illustrate the structure and operation of the lever, the pedal is not shown in FIGS. 2–5. The lever has a finger 46 which is engageable with the slots 36. The lever is biased by a spring 48 into an up position as shown in FIG. 2 wherein the finger 46 engages a slot. The lever may be rotated downward to a position shown in FIG. 4 wherein the spring is compressed and the finger disengaged from the slot so as to permit relative rotation of the intermediate and base members. A spring loaded ball 50 which serves as a detent for the lever projects through the outer surface of the base member 14*b*.

A combination of selective rotations of the base and intermediate members about the first axis 202 and intermediate members and platform about the second axis 204 provide for height and orientation adjustment of the upper surface 12 of the platform relative to the ground. In FIG. 2, the footrest is shown with the platform in a horizontal configuration substantially fully raised. The height of the platform is essentially determined by the height of the second axis 204. The height of this axis is solely dependant upon the relative orientation of the base and intermediate members which is controlled by relative rotation of the two members. To effect such rotation, the lever 42 is pivoted downward to disengage the finger 46 from the slot 36 as previously described. If the knobs 26 remain firmly engaged to the intermediate members 18*a* and 18*b*, rotation of the intermediate members relative to the base members will produce a tilt in the platform. Accordingly, if this is not desired, the knobs are loosened so as to permit relative rotation of the platform and right intermediate member. With this done, the platform may be lowered to a horizontal lowered configuration shown in FIG. 3 whereupon the finger may be reengaged with a slot and the knobs retightened. During this process, the stud 30 has passed from being adjacent to a first end 52 of the slot 32 (FIG. 3) to being adjacent a second end 54 (FIG. 2).

Figure 4:
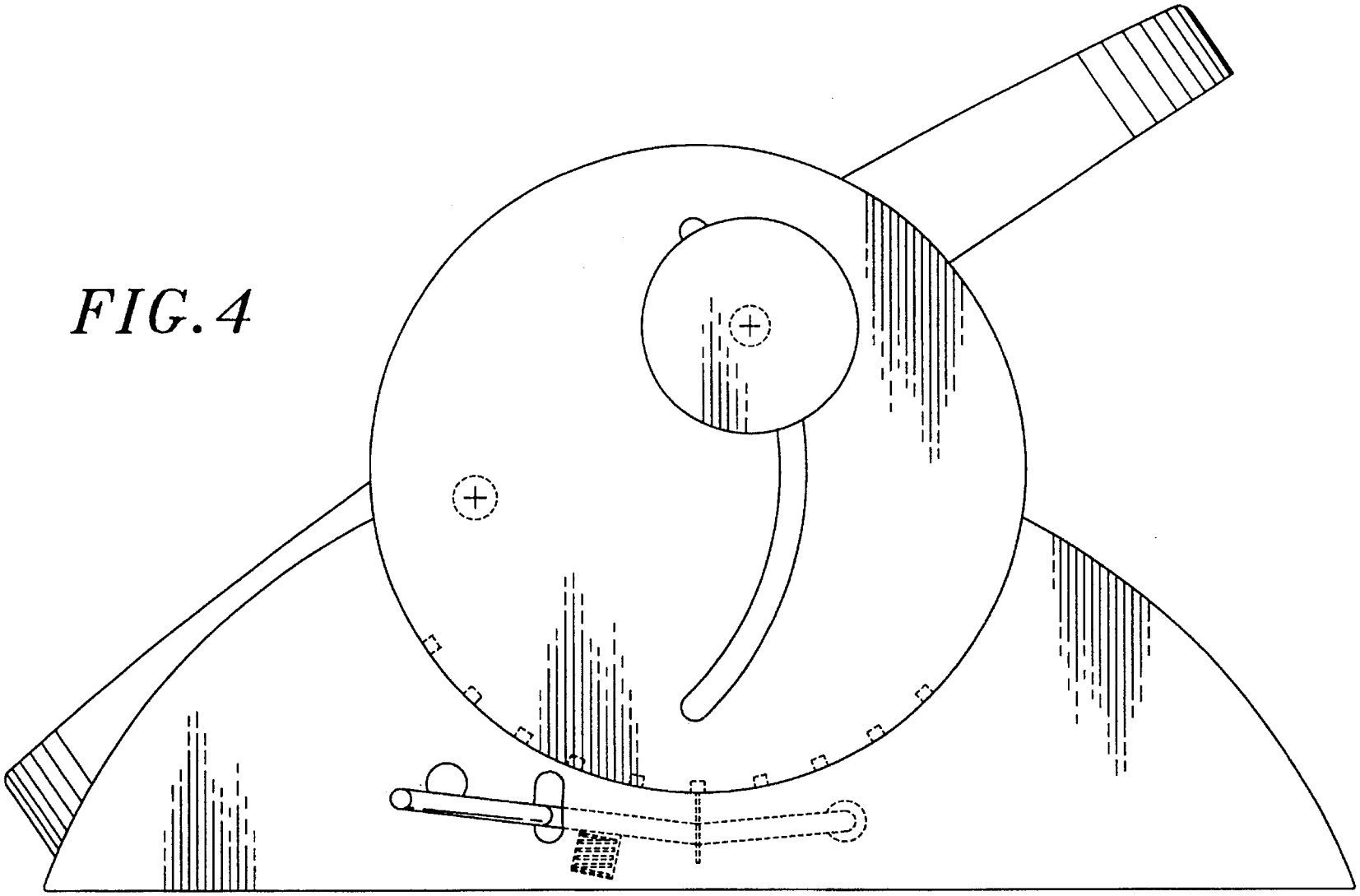
FIG. 4 is a semi-schematic right side view of the footrest shown in an extreme inclined configuration.
Figure 5:
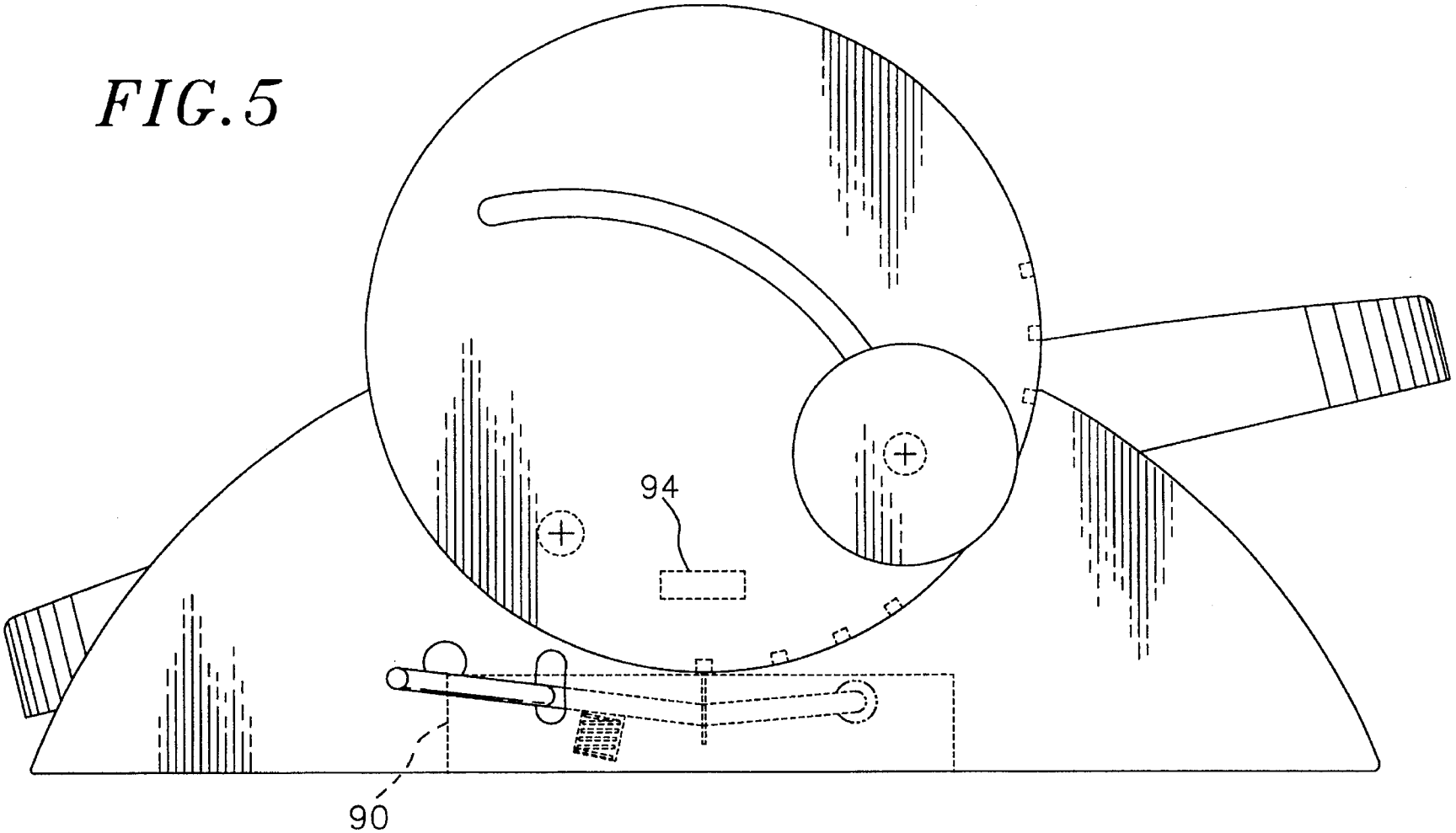
FIG. 5 is a semi-schematic right side view of the footrest shown in a shallow inclined configuration.
Figure 6A:
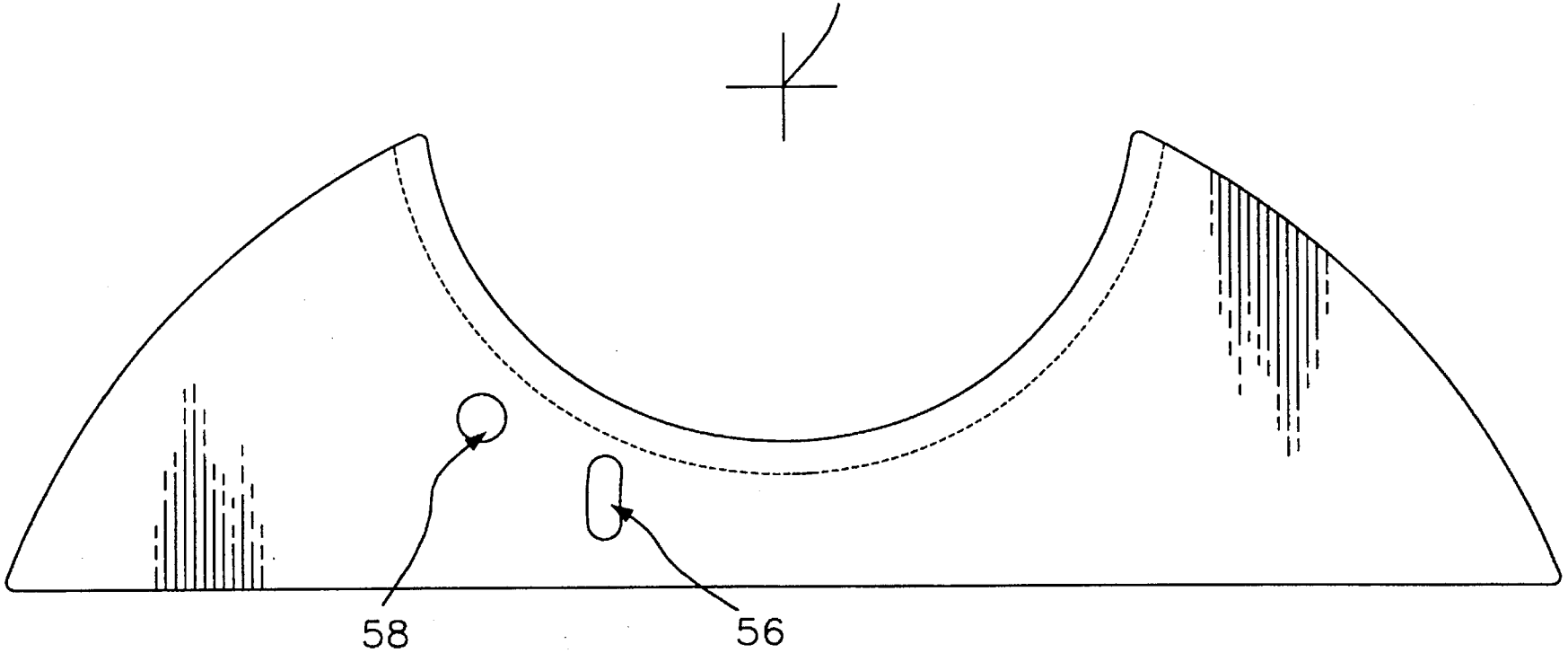
FIG. 6*a* is an elevational view of the outer side of an outside right base portion of the footrest.
Figure 6B:
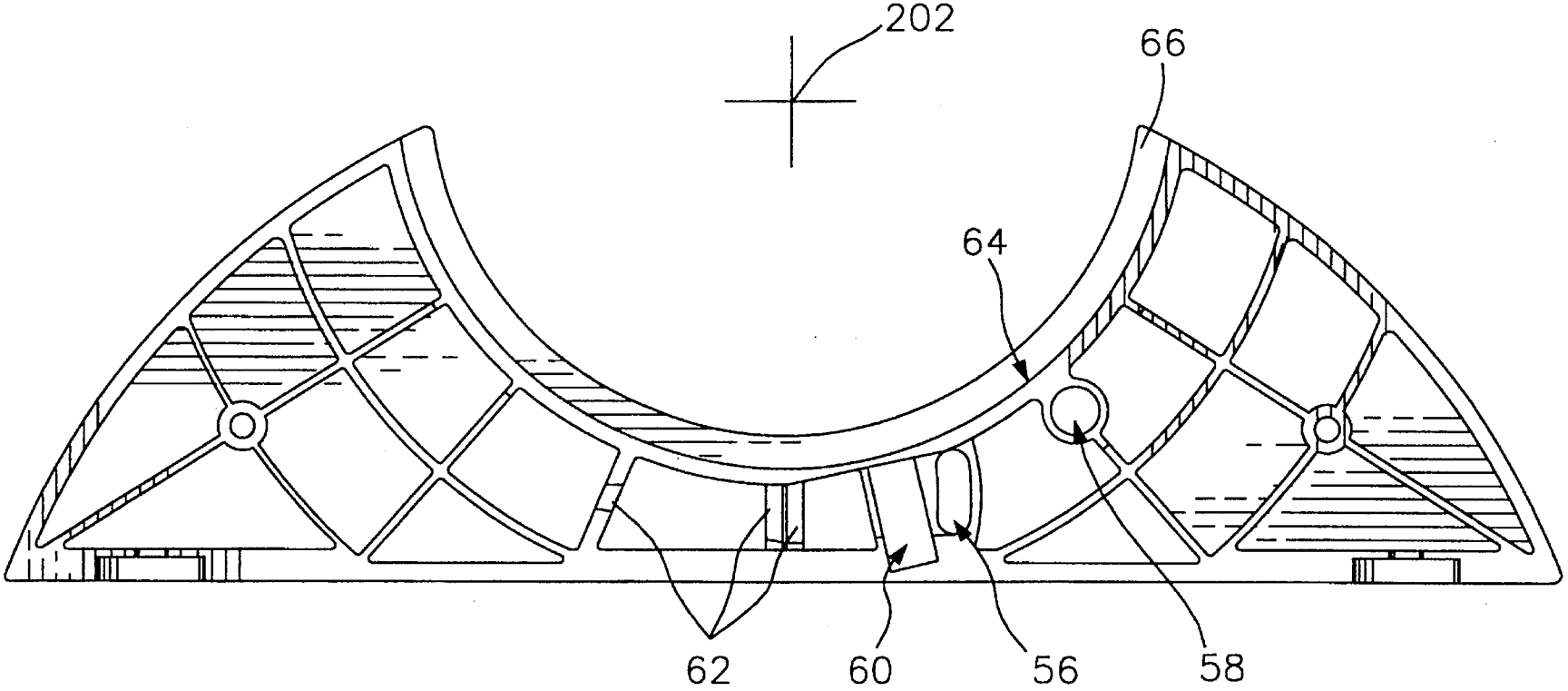
FIG. 6*b* is an elevation view of the inner side of the base portion of FIG. 6*a*.

As is shown in FIGS. 4 and 5, the platform may be adjusted to a variety of heights and orientations. Additionally, the footrest may be placed in a floating mode by leaving the knobs 26 loosened. In this way, the basic height is predetermined but the angle may be made to vary by the user altering the pressure applied by his or her feet to the platform. In such a mode, the footrest will provide support for the user's feet while allowing the angle between the user's feet and shins to fluctuate, reducing the likelihood of stiffening of the user's ankles.

Further details of the structure of the preferred embodiment are described with primary reference to FIGS. 6*a*–9. Each base member is formed with inside and outside pieces which are affixed to each other. The outside and inside pieces of the right base member 14*b* are shown in FIGS. 6*a* and 6*b* and 7*a* and 7*b*, respectively. The outside view of the outside piece of 6*a* shows a slot 56 through which the lever 42 passes as well as an aperture 58 through which the spring loaded ball 58 projects. As is shown in FIGS. 2 and 4, the lever may be snapped over the ball 50 to disengage the finger from the slot. In the inside view of FIG. 6*b*, the outside piece includes a semicylindrical bore 60 for accommodating the spring 48 and reliefs 62 in the structural ribs of the piece through which the lever shaft can pass. The piece has a semicylindrical surface 64 facing radially inward toward axis 202 for receiving and supporting the circular perimeter portion 38 of the intermediate member 18*b*. The piece additionally includes a semiannular lip 66 projecting radially inward from the surface 64 adjacent to the outer side of the piece. As is shown in FIG. 1, the lip 66 retains the intermediate member 18*b* against laterally outward movement.

Figure 7A:
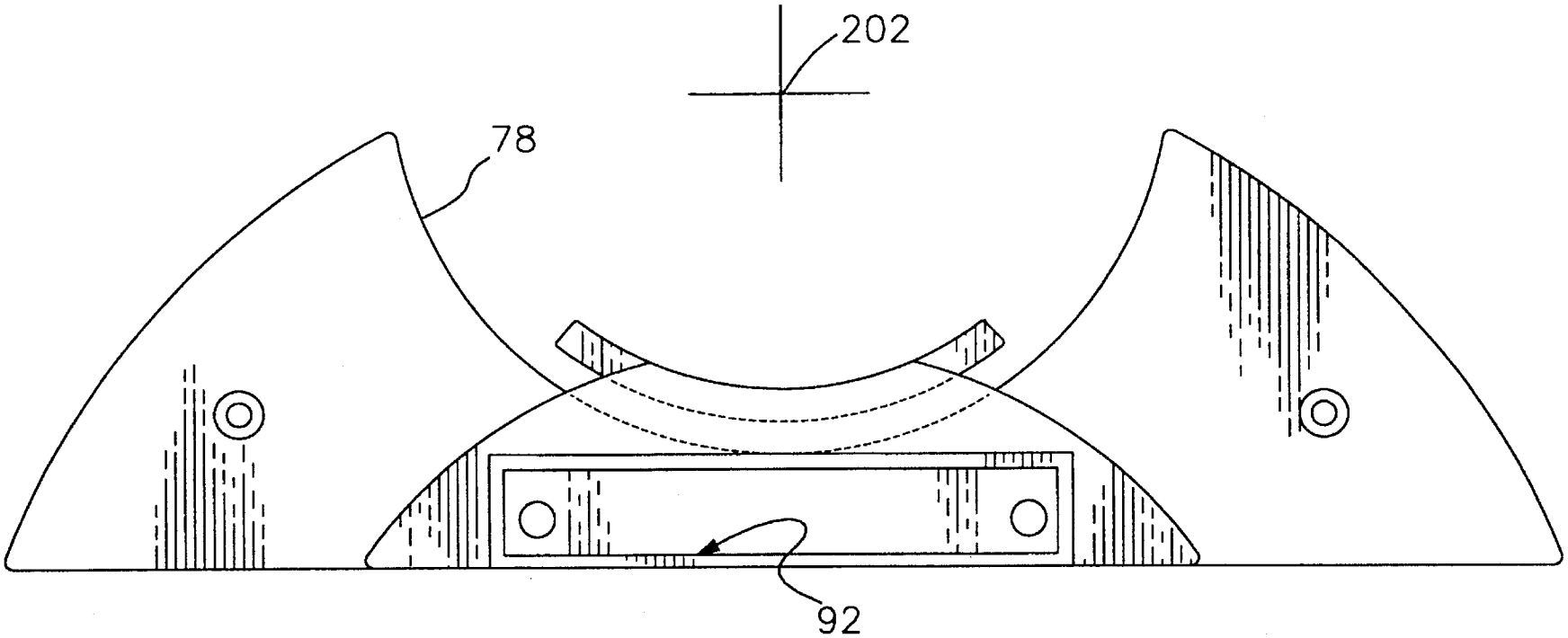
FIG. 7*a* is an elevational view of the outer side of an inside right base portion of the footrest.
Figure 7B:
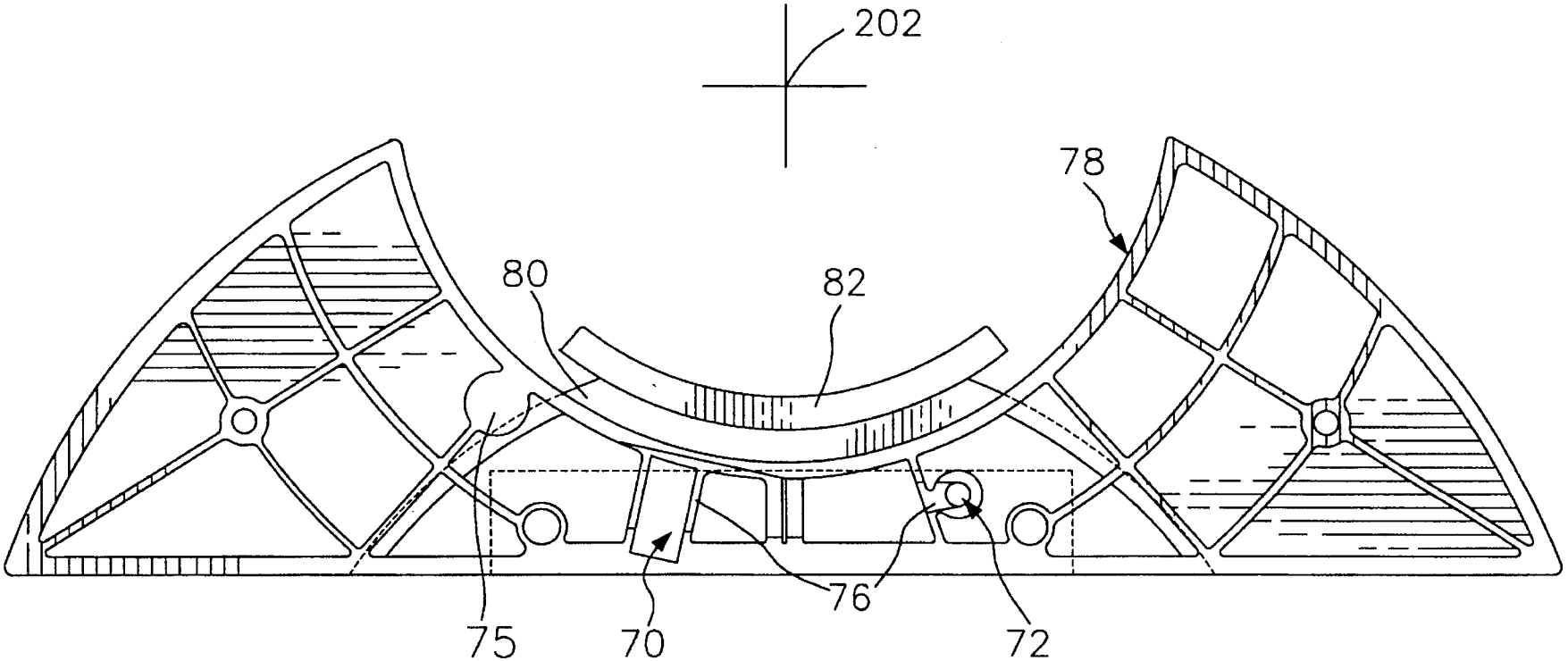
FIG. 7*b* is an elevation view of the inner side of the base portion of FIG. 7*a*.

The inner piece, shown in FIGS. 7*a* and 7*b*, which mates with the outer piece has a semicylindrical bore 70 (FIG. 7*b*) which, when the pieces are assembled, aligns with the bore 60 to form a full cylindrical bore encompassing the spring 48. The piece additionally includes a small lateral bore 72 which receives the transversely bent end 74 (FIG. 2) of the lever 42. The bore 72 is coincident with the axis 206 to provide the pivot for the lever. A substantially circular plateau 75 is positioned to align with the aperture 58 of the outer piece for supporting the spring (not shown) of the spring-loaded ball 50 (FIG. 2). Reliefs 76 are formed in the inner piece similar to those reliefs 62 of the outer piece. The piece has a semicylindrical surface 78 facing radially inward toward axis 202. When the inner and outer pieces are joined, their surfaces 64 and 78 align, forming a single surface for receiving and supporting the circular perimeter portion 38 of the intermediate member 18*b*. An annular flange 80 extends radially inward from the inner edge of the inner piece and carries an annular tongue 82 extending laterally outward concentric with and inside of the surface 78. When the pieces are assembled, the tongue 82 rides in an annular slot 84 (FIG. 8) in the intermediate member 18*b*, which slot has the axis 202 as its axis of curvature. Accordingly, the interaction of the tongue 82 and lip 66 of the respective inner and outer pieces retain the intermediate member permitting only rotation about the axis 202.

Figure 8:
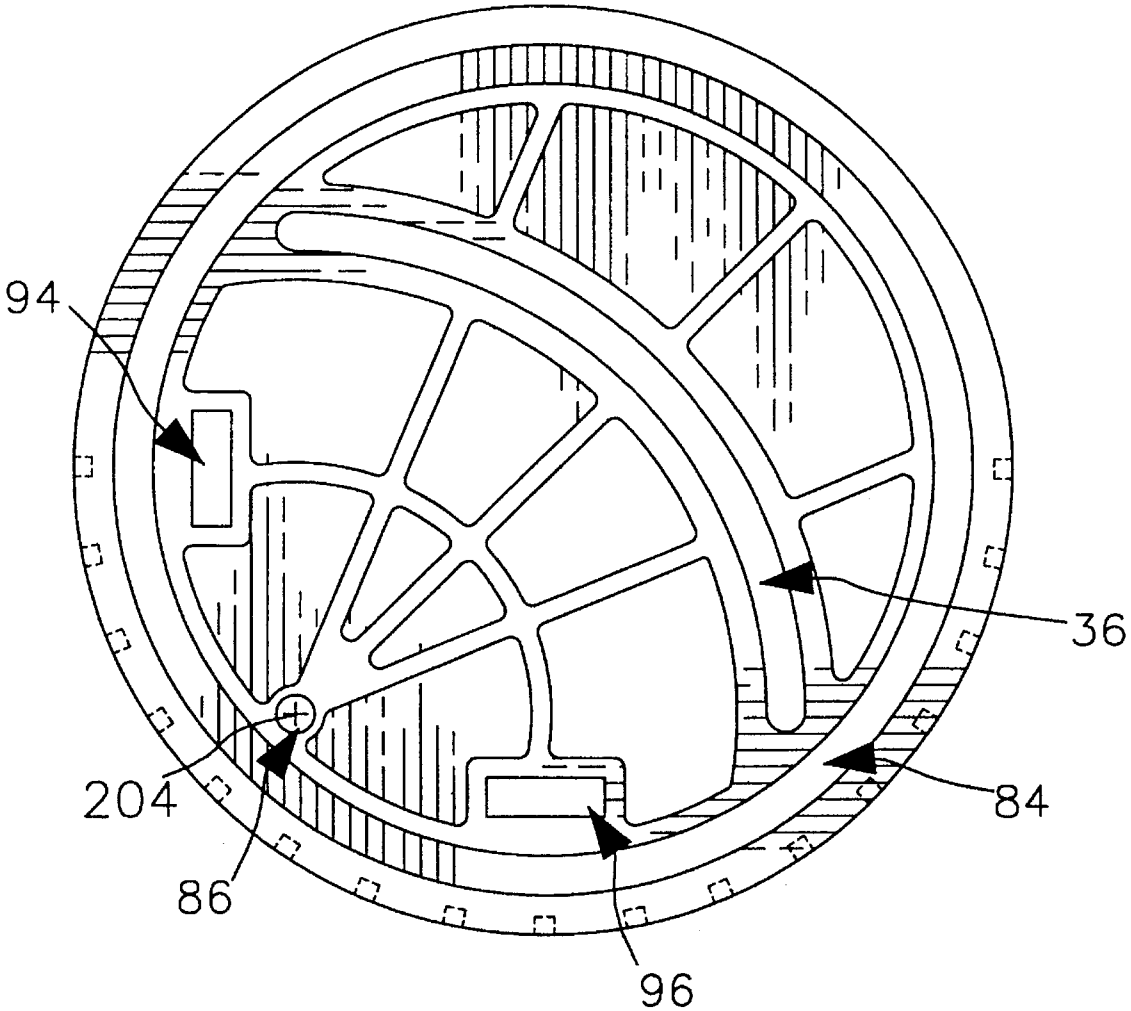
FIG. 8 is an inner view of an intermediate wheel of the footrest.

As is further shown in FIG. 8, the intermediate member 18*b* has a bore 86 coincident with the axis 204 for receiving the pin 22. The bore does not penetrate through the outer surface of the intermediate member.

To increase the structural rigidity of the footrest, a pair of cross members are provided. A first cross member 90 (FIG. 5) extends between the two base members. In the illustrated embodiment, this cross member is formed of a finished particle board approximately 17½ inches in length, 4½ inches in width and ¾ of an inch in height. The cross member is received by a pocket 92 in the inner piece and secured with screws (not shown).

A second cross member 94 connects the two intermediate members to ensure that they rotate together. This cross member is approximately 18½ inches long, ¾ of an inch wide and ¼ of an inch high, and is received by a pocket 94 in the intermediate member (FIG. 8).

The inner and outer pieces of the left base member 14*a* are formed identically to those of the right base member 14*b*, lacking, however, the features associated with the lever 42 (given their front to rear symmetry, they are not merely mirror images of the right base member pieces). Similarly, the left intermediate member 18*a* is formed as a mirror image of the right intermediate member 18*b*. As is shown in FIG. 8, the intermediate member 18*b* may be manufactured with an additional pocket 96 located on an opposite side of the axis 204 from the pocket 94. The presence of the pocket 96 allows the intermediate member to be used either as a left or right member. Where such an interchangeability is desired, the slots 38 must either be created after the molding of the intermediate member or must similarly be made in a symmetric fashion (not shown).

Figure 9:
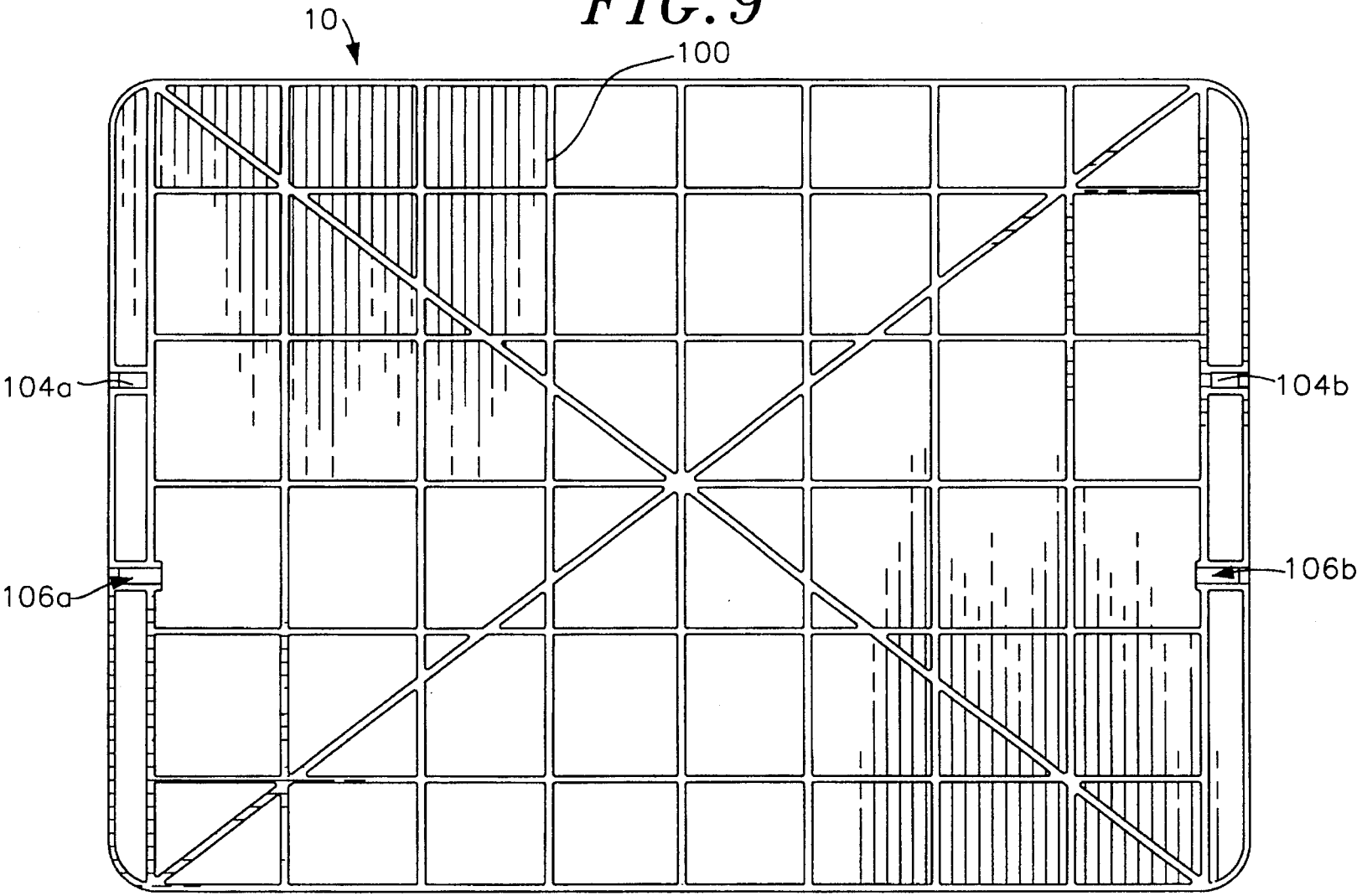
FIG. 9 is a bottom view of the platform of the footrest.

The underside of the platform 10 is shown in FIG. 9. The platform is molded with a plurality of strengthening ribs 100. Extending into the respective left and right sides of the platform are slots 104*a* and 104*b* for receiving and accommodating the pins 22. Additionally, slots 106*a* and 106*b* are provided for accommodating the studs 30. Whereas the slots 104*a* and 104*b* are close ended, slots 106*a* and 106*b* are open ended for accommodating the head (not shown) of the stud.

Figure 10:
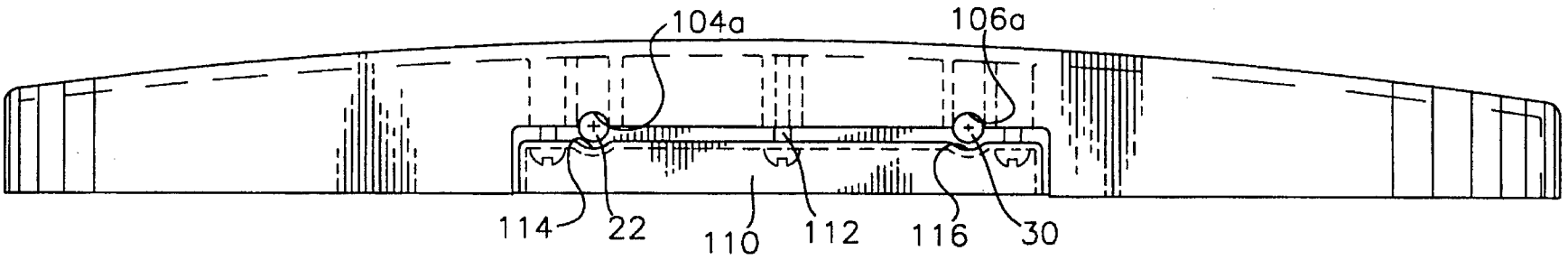
FIG. 10 is a side elevation view of the platform of the footrest.

As is shown for the left side of the platform in FIG. 10, the pins 22 and studs 30 are secured to the platform by clamps 110 which are held with screws 112. In their upper surfaces the clamps 110 each have a pair of channels 114 and 116 which align with the slots 104 and 106 (*a* and *b*) to bear against the pins and studs for holding them in place.

While a preferred embodiment of a footrest has been described and illustrated herein, other constructions will be apparent to those skilled in the art. It is therefore to be understood that, within the scope of the appended claims, the invention may be practiced otherwise than as specifically described.

What is claimed is:

1. A footrest for supporting the feet of a user above a support surface comprising:

a base for supporting the footrest on the support surface; and at least one intermediate member having a peripheral outer edge surface, the peripheral outer edge surface rotatably supported by a base surface and slidably interfitted with a portion of the base allowing for relative rotation about a first axis; and a platform having an upper surface for accommodating the feet of the user, the platform rotatably coupled to the intermediate member for relative rotation about a second axis offset from the first axis so that selective rotations about the first and second axes provide for height and orientation adjustment of the upper surface of the platform relative to the support surface.

2. The footrest of claim 1, wherein the first and second axes are parallel.

3. The footrest of claim 2, wherein there are a left and a right such intermediate members positioned adjacent left and right sides of the platform.

4. The footrest of claim 3, wherein the base comprises left and right base portions engaging the left and right intermediate members, respectively.

5. The footrest of claim 4, wherein the base further comprises a cross member connecting the left and right base portions.

6. The footrest of claim 4, wherein each of the left and right base portions comprises a lateral tongue riding on a curved slot having the first axis as its axis of curvature.

7. The footrest of claim 6, wherein the lateral tongues point outward away from the platform.

8. The footrest of claim 4, wherein the left and right intermediate members have a generally circular perimeter portion.

9. The footrest of claim 4, further comprising a cross member connecting the left and right intermediate members.

10. The footrest of claim 3, further comprising locking means for selectively restricting relative rotation of the platform and the left and right intermediate members.

11. The footrest of claim 10, wherein the locking means comprises a shaft engaged to the platform and passing through a slot in one of said left and right intermediate members, a knob engaged to the shaft, and means for causing the knob to bear against the one intermediate member to securely engage the one intermediate member for resisting relative rotation of the one intermediate member and the platform.

12. The footrest of claim 11 wherein the knob is threaded to enable it to be tightened against the intermediate member.

13. A footrest for supporting the feet of a user above a support surface comprising:

a base;

at least one intermediate member having at least a generally circular perimeter edge portion, the generally circular perimeter edge portion supported by a concave base surface and slidably interfitted with the concave base surface allowing for rotation of the intermediate member relative to the base about a first axis; and a platform having an upper surface for accommodating the feet of the user, the platform rotatably coupled to the intermediate member about a second axis offset from the first axis for rotating in relation to the intermediate member.

14. The footrest of claim 13, wherein the second axis laterally spans the platform, and wherein said second axis is parallel to the first axis.

15. The footrest of claim 13, wherein the base further comprises a tongue, and the intermediate member generally circular perimeter portion further comprises a curved slot curved about the first axis, wherein the tongue rides on the curved slot for guiding the rotation of the intermediate member relative to the base.

16. The footrest of claim 13, further comprising a means for selectively restricting the rotation of the platform relative to the intermediate member.

17. The footrest of claim 13, further comprising means for selectively restricting the rotation of the intermediate member relative to the base.

18. A footrest for supporting the feet of a user above a support surface comprising:

a base for supporting the footrest on the support surface comprising left and right base portions and a locking member;

left and right intermediate members having a generally circular perimeter portion rotatably coupled respectively to the left and right base portions allowing for relative rotation about a first axis;

a plurality of locking features located on the circular perimeter portion of one member of the left and right intermediate members, the locking features engageable with the locking member of the base for restricting rotation of the one member relative to the base; and a platform having an upper surface for accommodating the feet of the user, the platform positioned between the intermediate members and rotatably coupled to the intermediate members for relative rotation about a second axis offset in parallel from the first axis so that selective rotations about the first and second axes provide for height and orientation adjustment of the upper surface of the platform relative to the support surface.

19. The footrest of claim 18, wherein the locking features comprise laterally extending slots.

20. The footrest of claim 19, wherein the locking member comprises a lever pivotally connected to the base and having a finger engageable with said plurality of locking features.

* * * * *